US011382824B2

(12) United States Patent
Wu

(10) Patent No.: US 11,382,824 B2
(45) **Date of Patent: *Jul. 12, 2022**

(54) ROTATABLE LEG MASSAGE DEVICE

(71) Applicants: Dong-Her Wu, Chang-Hua Hsien (TW); IREST HEALTH SCIENCE AND TECHNOLOGY CO., LTD, Iaxing (CN)

(72) Inventor: Dong-Her Wu, Chang-Hua Hsien (TW)

(73) Assignees: Dong-Her Wu, Chang-Hua Hsien (TW); IREST HEALTH SCIENCE AND TECHNOLOGY CO., LTD, Jiaxing (CN)

( * ) Notice: Subject to any disclaimer, the term of this patent is extended or adjusted under 35 U.S.C. 154(b) by 349 days.

This patent is subject to a terminal disclaimer.

(21) Appl. No.: 16/545,886

(22) Filed: Aug. 20, 2019

(65) Prior Publication Data

US 2020/0206069 A1 Jul. 2, 2020

(30) Foreign Application Priority Data

Dec. 28, 2018 (TW) ..... 107147801

(51) Int. Cl.
*A61H 15/00* (2006.01)

(52) U.S. Cl.
CPC . *A61H 15/0078* (2013.01); *A61H 2015/0021* (2013.01); *A61H 2015/0035* (2013.01); *A61H 2201/0119* (2013.01); *A61H 2201/1215* (2013.01); *A61H 2201/1642* (2013.01); *A61H 2201/1676* (2013.01); *A61H 2205/10* (2013.01)

(58) Field of Classification Search
CPC ..... A61H 15/00; A61H 15/0078; A61H 2015/0021; A61H 2015/0035; A61H 2201/0119; A61H 2201/1215; A61H 2201/1642; A61H 2201/1676; A61H 2201/164; A61H 2201/50; A61H 2201/1671; A61H 2201/0149; A61H 2201/1207; A61H 7/004; A61H 2205/10; A61H 2205/088; A61H 2205/108; A61H 2205/12; A61H 2205/106; A61H 2205/125; A61H 2203/0431; A61H 2203/0443; A61H 1/0214; A61H 1/024; A61H 1/0244; A61H 1/0255; A61H 1/0259; A61H 1/0266;

(Continued)

(56) References Cited

U.S. PATENT DOCUMENTS 3,116,955 A * 1/1964 Siegal ..... A47C 7/5066 297/423.35
4,782,823 A * 11/1988 Yamasaki ..... A61H 15/0078 601/127

(Continued)

*Primary Examiner* — Colin W Stuart
*Assistant Examiner* — Douglas Y Sul

(57) ABSTRACT

A rotatable leg massage device has a base and a swinging arm. The base has two opposing assembling posts at one end and a limiting baffle behind and between the two assembling posts. The swinging arm has a massaging end and a swinging end, the massaging end is provided with a respective massaging roller on two sides, a first motor is configured to rotate the two massaging rollers, the swinging end is disposed between the two assembling posts of the base, a second motor is disposed between the swinging end and the two assembling posts and configured to drive the swinging arm to rotate around the base.

7 Claims, 15 Drawing Sheets

(58) Field of Classification Search
CPC .... A61H 1/0237; A47C 1/034; A47C 1/0355; A47C 7/5066; A47C 7/5068
See application file for complete search history.

(56) References Cited

U.S. PATENT DOCUMENTS

| | | | | |
|---|---|---|---|---|
| 5,551,951 | A * | 9/1996 | Fradkin | A61H 15/00 601/115 |
| 6,056,709 | A * | 5/2000 | Hashimoto | A61H 15/0078 601/118 |
| 7,192,406 | B2 * | 3/2007 | Marten | A61H 15/0078 601/127 |
| 2004/0030274 | A1 * | 2/2004 | Wu | A61H 15/0078 601/115 |
| 2005/0090769 | A1 * | 4/2005 | Chen | A61H 15/0078 601/99 |
| 2006/0006724 | A1 * | 1/2006 | Shimizu | A61H 7/004 297/423.26 |
| 2011/0034839 | A1 * | 2/2011 | Yang | A61H 15/0078 601/128 |
| 2015/0021969 | A1 * | 1/2015 | Yin | A47C 7/506 297/423.26 |
| 2020/0206071 | A1 * | 7/2020 | Wu | A61H 1/00 |

* cited by examiner

ROTATABLE LEG MASSAGE DEVICE

BACKGROUND of INVENTION

Field of Invention

The present invention relates to a massage device, and more particularly to a rotatable leg massage device.

Description of the Related Art

In modern life, people are under various stress and are easily suffer body aches. Therefore, various massage devices are employed to massage different parts of the body to ease the body tension. The general massage devices are divided into a body massage device such as a massage chair, a massage bed, etc., and a partial massage device such as a shoulder-neck massage belt, a waist massage belt or a calf and foot massage machine, etc. All of them employ rollers, airbags or vibration to generate mechanical press on corresponding body parts to relieve the tension of the muscles.

In particular, there are more and more people suffer soreness, tightness and water retention in their lower limbs. Therefore, lower limb massage mechanisms are developed to provide massage for lower limbs and feet. The lower limb massage device can be used alone or in combination with a massage chair. However, common lower limb massage mechanisms usually has a complicated massage mechanism which is requires too much space.

On the other hand, the lower limb massage mechanism in a massage chair can be used to lift and lower the massage chair to enhance the massage effect, but limits the use state of the lower limb massage mechanism. The lower limb massage mechanism requires the user sits down and places both legs on the lower limb massage mechanism, and the effective areas are limited to the calf, ankle or sole Therefore, it is desirable to provide a rotatable leg massage device to mitigate and/or obviate the aforementioned problems.

SUMMARY OF THE INVENTION

An objective of present invention is to provide a rotatable leg massage device, which is capable of improving the above-mention problems.

In order to achieve the above mentioned objective, a rotatable leg massage device has a base and a swinging arm. The base has two opposing assembling posts at one end and a limiting baffle behind and between the two assembling posts. The swinging arm has a massaging end and a swinging end, the massaging end is provided with a respective massaging roller on two sides, a first motor is configured to rotate the two massaging rollers, the swinging end is disposed between the two assembling posts of the base, a second motor is disposed between the swinging end and the two assembling posts and configured to drive the swinging arm to rotate around the base.

Other objects, advantages, and novel features of invention will become more apparent from the following detailed description when taken in conjunction with the accompanying drawings.

DETAILED DESCRIPTION OF THE PREFERRED EMBODIMENT

Figure 1:
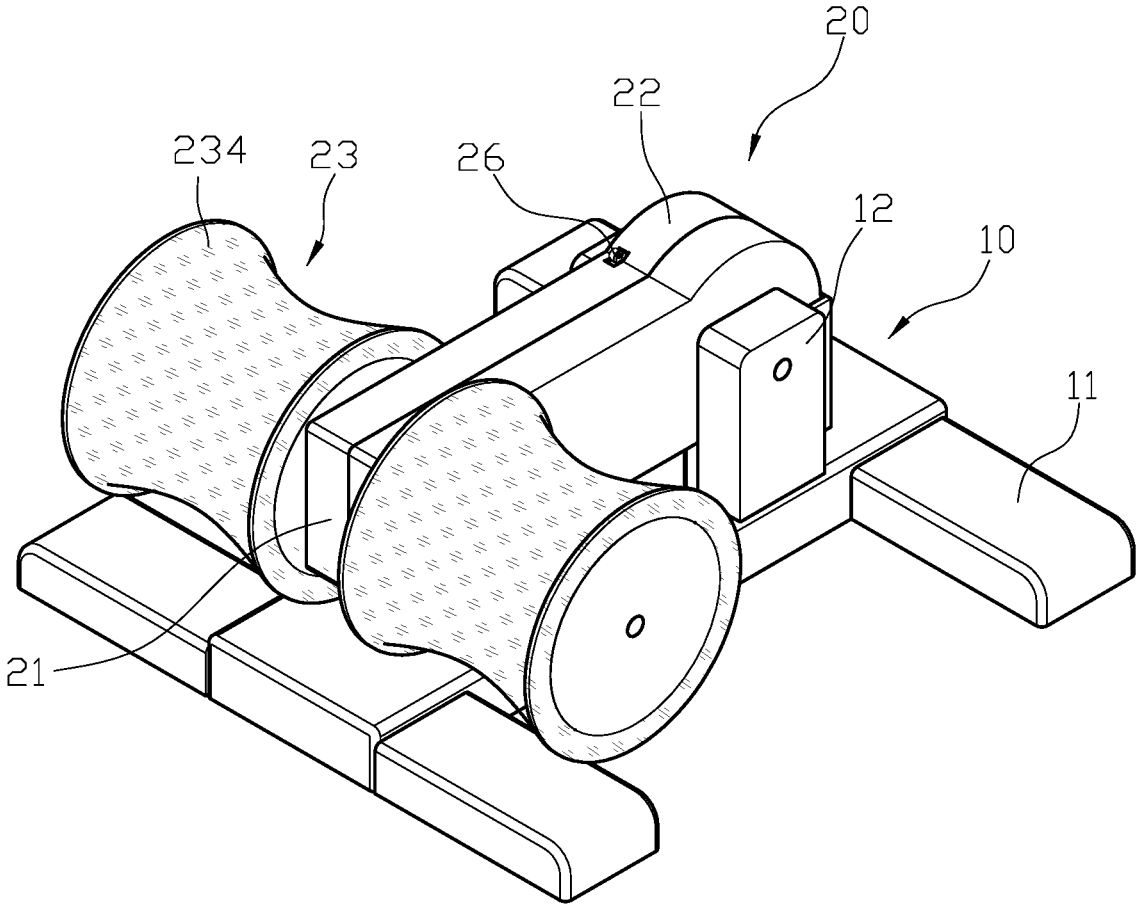
FIG. 1 is a perspective view of a preferred embodiment according to the present invention.
Figure 2:
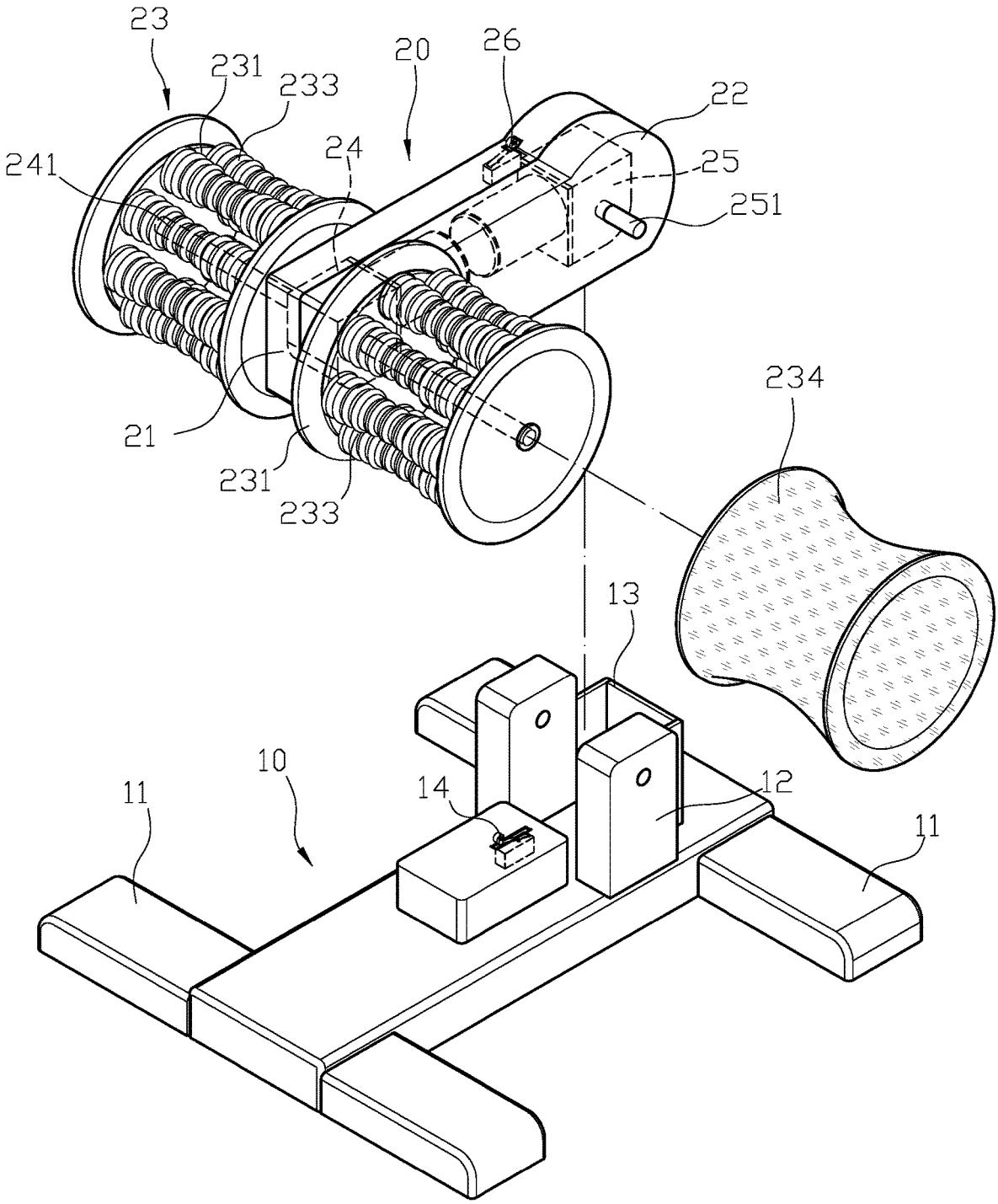
FIG. 2 is an exploded view of the preferred embodiment according to the present invention.
Figure 3:
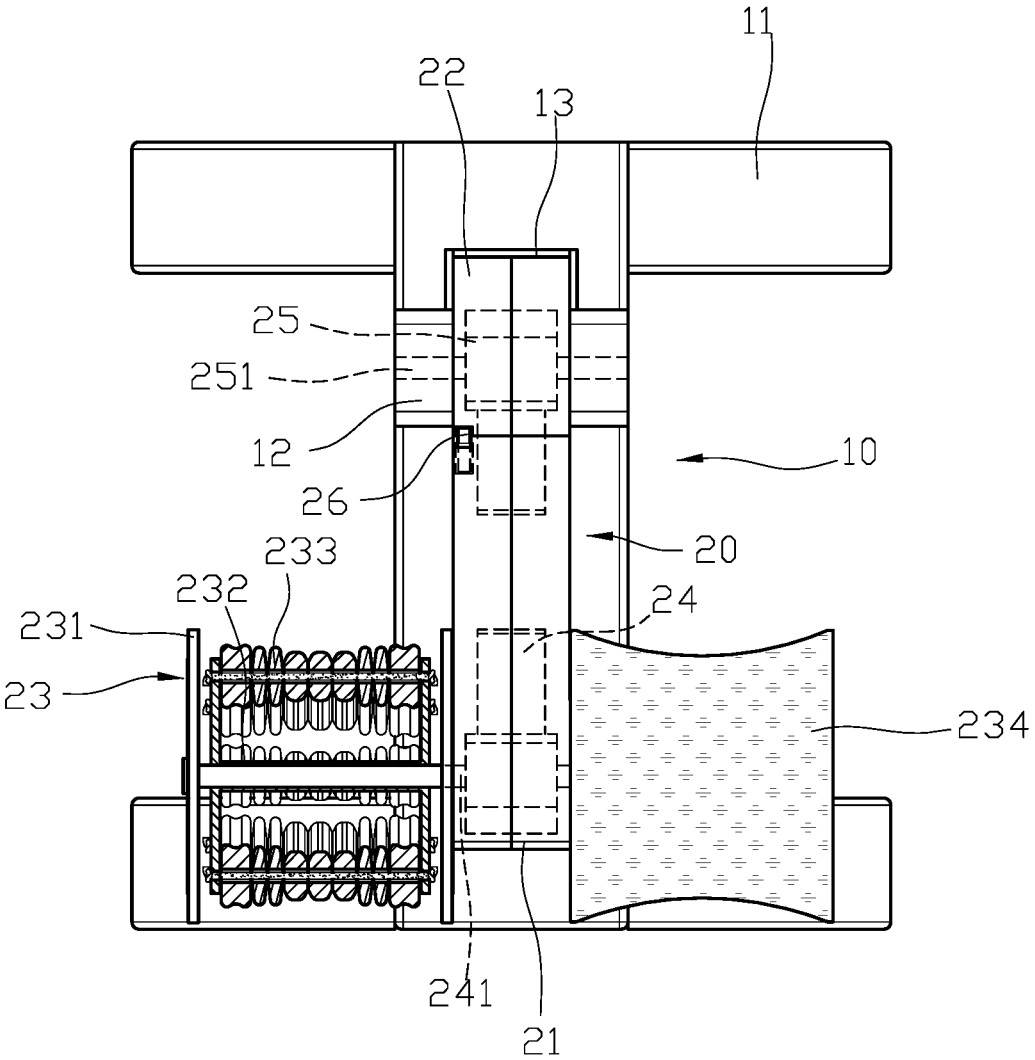
FIG. 3 is a plan view of the preferred embodiment according to the present invention.
Figure 4:
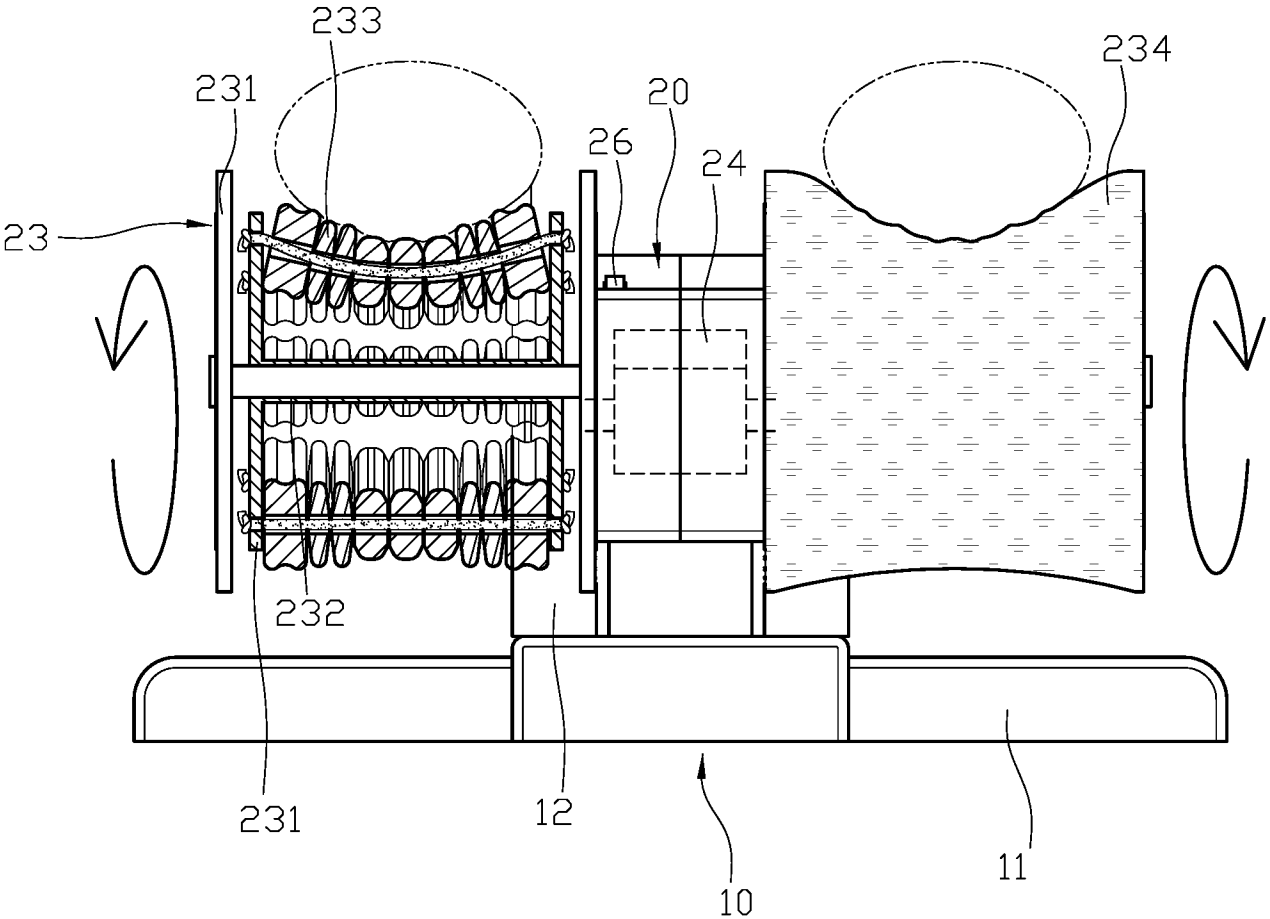
FIG. 4 is a front view of the preferred embodiment according to the invention

Please refer to FIGS. 1-4. The rotatable leg massage device comprises: a base 10 and a swinging arm 20. Two sides of the base 10 are each provided with a foot stand 11, and the base 10 further has two opposing assembling posts 12 and a limiting baffle 13 behind and between the two assembling posts 12. The limiting baffle 13 is U-shaped, and a highest point of the limiting baffle 13 is lower than the two assembling posts 12 such that the swinging arm 20 is able to have a rotation angle larger than 90° relative to the base 10. The swinging arm 20 has a massaging end 21 and a swinging end 22. The massaging end 21 end provided with a respective massaging roller 23 on two sides. The two massaging rollers 23 each further comprise a circular disk 231 connected to a shaft 232, and the two circular disks 231 are provided with a plurality of massaging units 233 there between. The two massaging rollers 23 the two massaging rollers are both covered by a cloth cover 234. The massaging end 21 further comprises a first motor 24, the first motor 24 drives a central shaft 241 to rotate with the shaft 232 of the two massaging rollers 23 together. The swinging end 22 is disposed between the two assembling posts 12 of the base 10, and a second motor 25 is disposed between the swinging end 22 and the two assembling posts 12 and configured to drive the swinging arm around the base. The second motor 25 is mounted in the swinging end 22 of the swing arm 20, and both ends of the second motor 25 have a shaft rod 251 passing through the swinging end 22 and engaged with the two assembling posts 12. The second motor 25 drive the swinging arm 20 to rotate around the base 10.

Moreover, a first limit switch 14 is mounted in front of the two assembling posts 12 of the base 10, a second limit switch 26 is mounted on the swinging arm 20 adjacent the swinging end 22, and the first and second limit switches 14, 26 are both are electrically connected to the second motor. 25.

Figure 5:
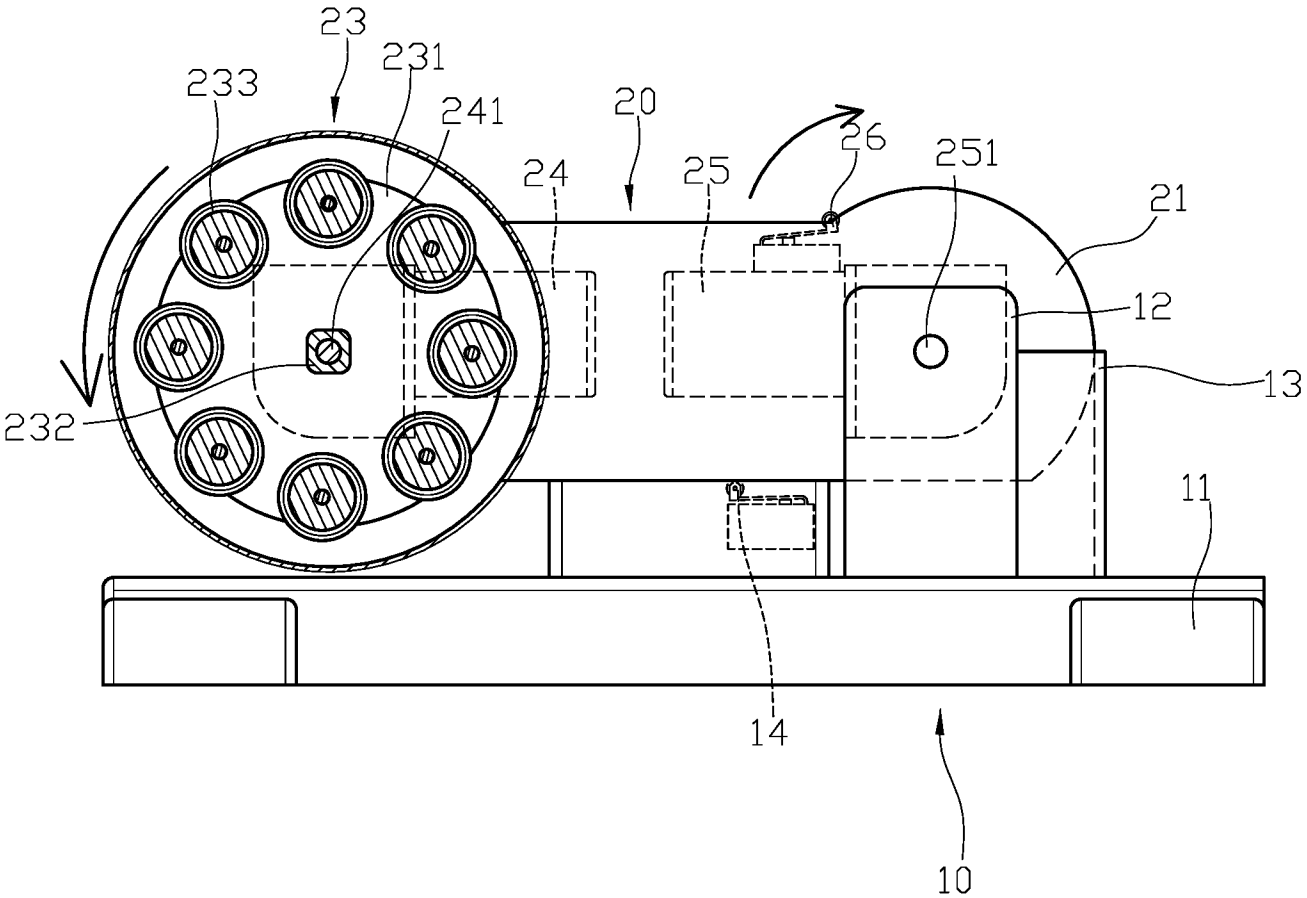
FIG. 5 is a side view of the preferred embodiment according to the invention.
Figure 6:
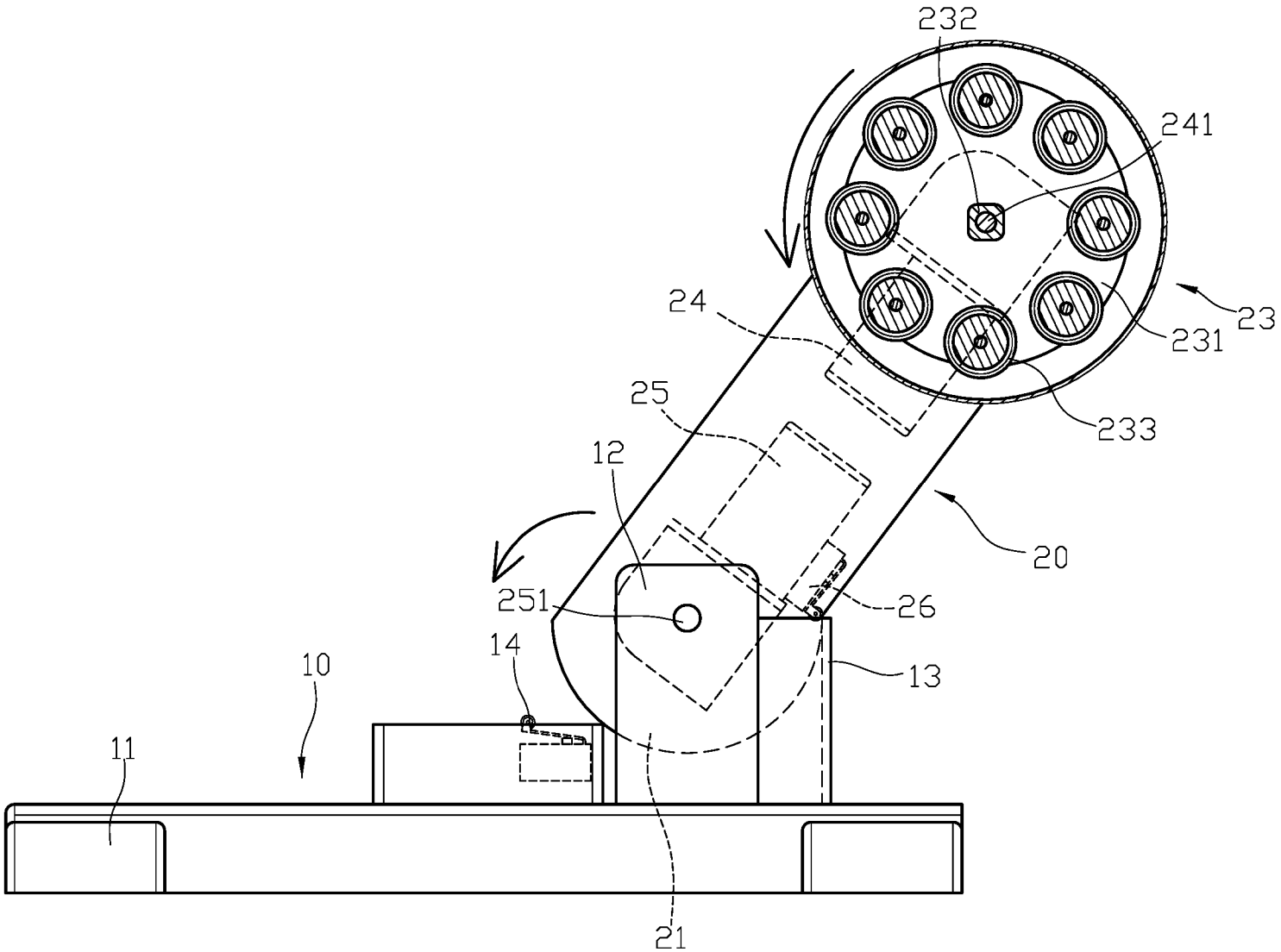
FIG. 6 is a schematic view showing the swing state of the preferred embodiment according to the present invention.

For structural assembly and operation, please refer to FIGS. 1-4 with FIGS. 5 and 6. The massaging end 21 of the swinging arm 20 is rotated by the first motor 24 and drives the two massaging rollers 23 to rotate, the swinging end 22 of the swinging arm 20 is provided with the second motor 25, and the swinging end 22 is mounted between the two assembling posts 12 of the base 10 and the limiting baffle 13. Since the second motor 25 is fixed on the swinging end 22 and the two shaft rods 251 passing through the swinging end 22 are fixed to the sides of the two assembling posts 12. When the two shaft rods 251 are fixed, the second motor 25 operates with the shaft rod 251 as the axis to drive the swinging arm 20 to swing between the two assembling posts 12. The first limit switch 14 is disposed in front of the two assembling posts 12 of the base 10 and the swinging arm 20 has a second limit switch 26 on its outside, when the swinging arm 20 is driven by the second motor 25 and swinging forward and to touch the first limit switch 14 of the base 10, the switch is activated to make the second motor 25 to rotate reversely to swing the swinging arm 20 in the opposite direction. Conversely, when the swinging arm 20 swings back and touches the limiting baffle 13 with the second limit switch 26, the second motor 25 is switched back to a forward rotation and causing the swinging arm 20 to swinging forward toward the front of the base 10. Therefore, the swinging arm 20 accomplishes reciprocating swing movements, and the massaging rollers 23 of the massaging end 21 provide the massage effect of the lower limbs. Moreover, the limiting baffle 13 is lower than the two assembling posts 12, which allows the swinging arm 20 to have a swing angle greater than 90 degrees on the base 10 and greatly increases the massage range for the lower limbs.

In addition, the previous switching method of the second motor 25 by using the limit switch is only one of the preferred embodiment of the present invention, and is not limited thereto, it can also be accomplished by setting a predetermined numbers of rotation of the second motor 25, other sensing switches or gyroscopes for the switching, etc. to provide the switching effect for the rotation direction of the second motor 25.

Figure 7:
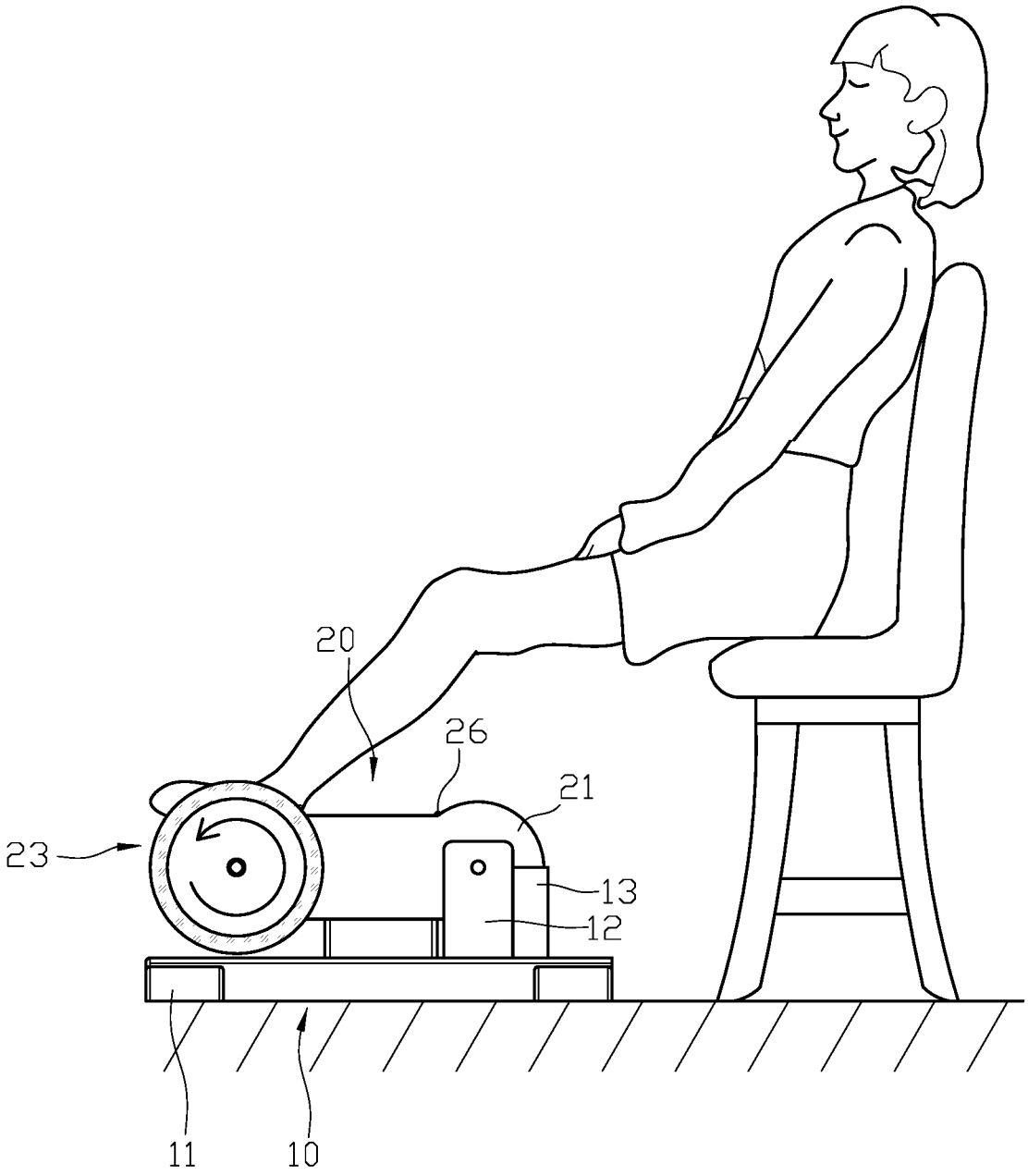
FIG. 7 is a schematic view showing a user sitting on the preferred embodiment according to the present invention.
Figure 8:
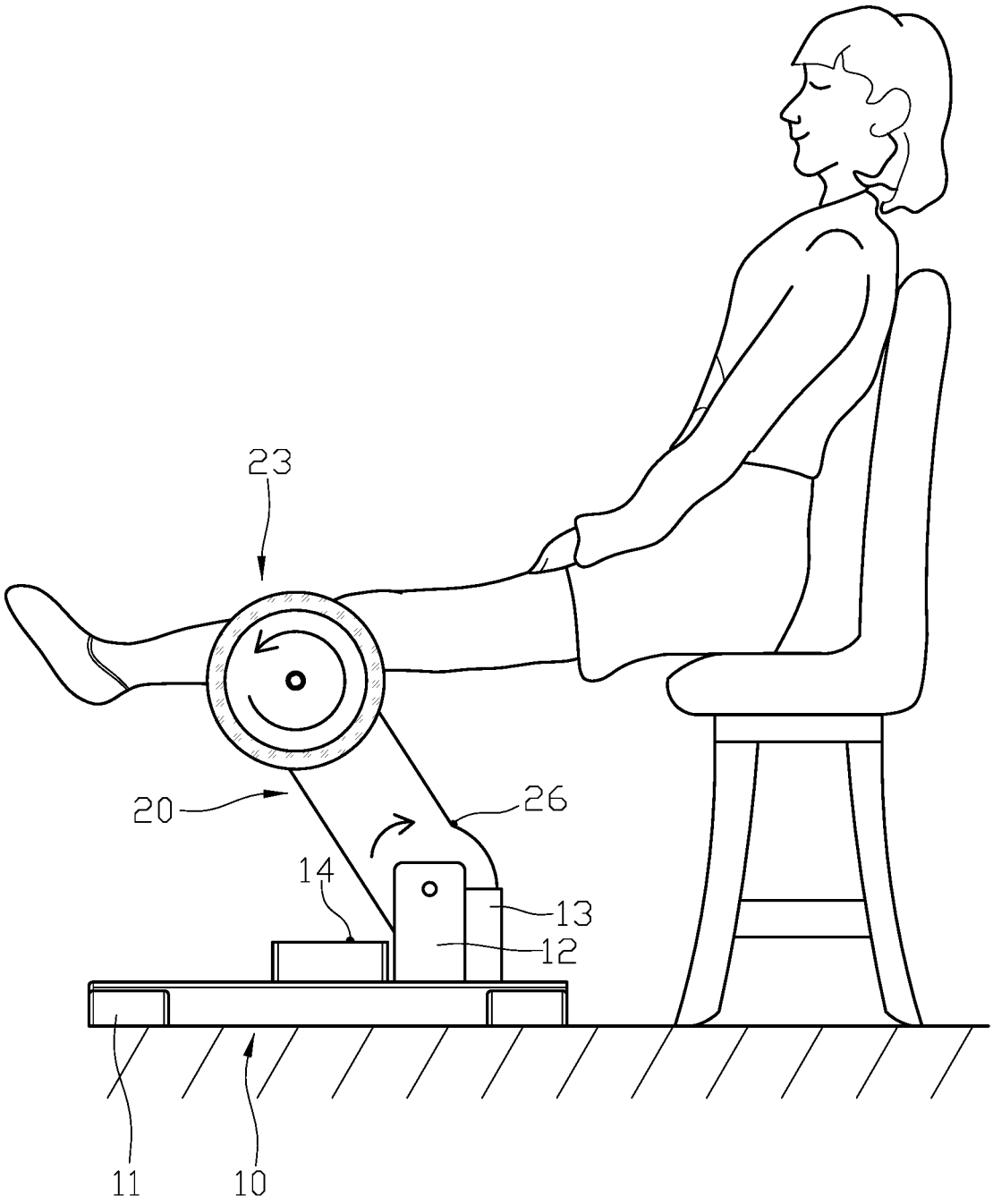
FIG. 8 is another schematic view showing a user sitting on the preferred embodiment according to the present invention.
Figure 9:
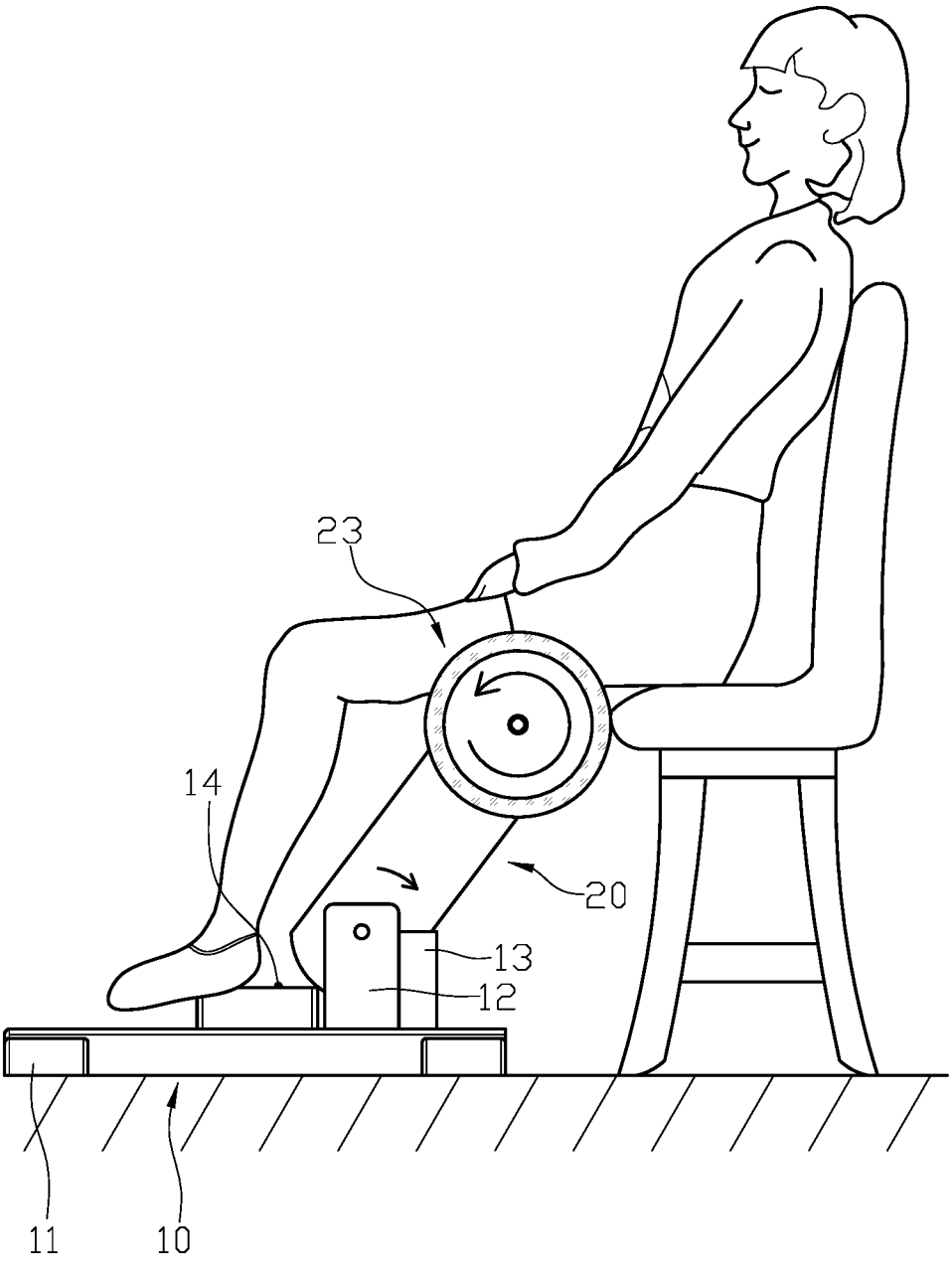
FIG. 9 is another schematic view showing a user sitting on the preferred embodiment according to the present invention.

When the above structure is actually operated, as shown in FIGS. 7, 8, and 9, the user sits on a chair, the massage device is placed in front of the chair, and user's feet are placed on the swinging arm 20. When the first motor 24 and the second motor 25 are simultaneously activated, the two massaging rollers 23 are rotated by the first motor 24 and massage the lower limb muscles via the massaging unit 233, while the swinging arm 20 moves with the second motor 25, and the two massaging rollers 23 of the massaging end 21 massages along the feet, ankles, calves, back of the knees and thighs to achieve a lower limb circulation massage. Furthermore, when the calves are been massaged, the feet can be lifted up to relax the leg muscles, which greatly enhances the massage effect.

Secondly, the first motor 24 and the second motor 25 are connected to a controller (not shown), and the power of the first motor 24 can be controlled by the controller to adjust the speed of the two massaging rollers 23 and the massage force. The controller can also be used to control the second motor 25 to be on or off, and by fixing the angle of the swinging arm 20 to provide a fixed-point massage at the sole of the foot, the calf muscle, the muscle of the back of the knee or the thigh muscle.

Figure 10:
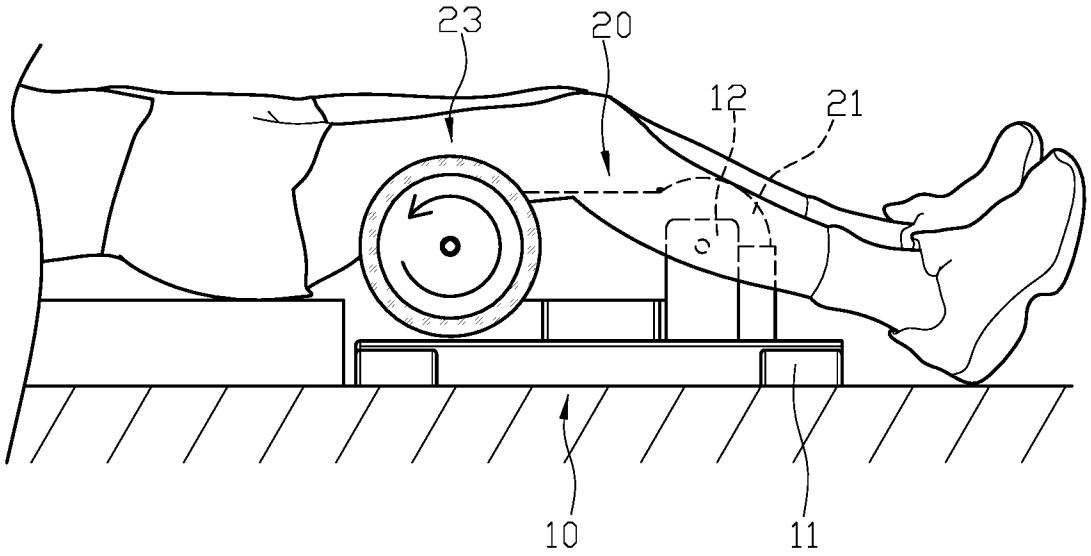
FIG. 10 is a schematic diagram showing the user lying down on the preferred embodiment according to the present invention.
Figure 11:
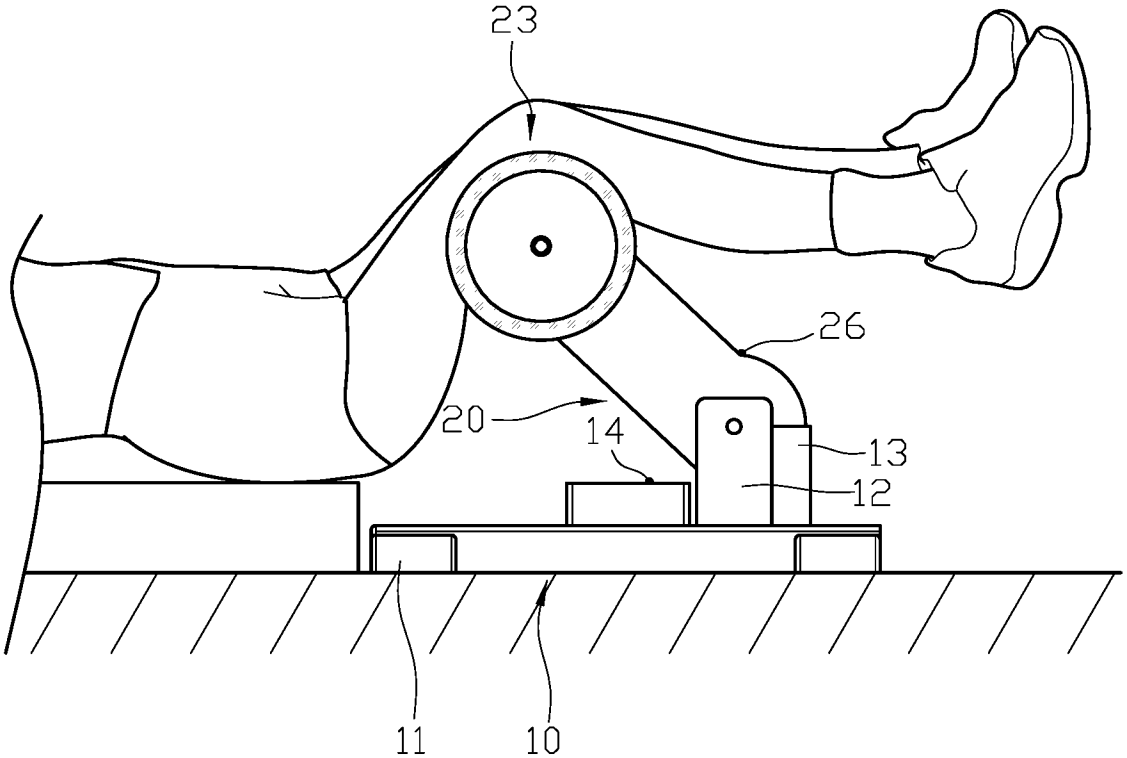
FIG. 11 is another schematic diagram showing the user lying down on the preferred embodiment according to the present invention.
Figure 12:
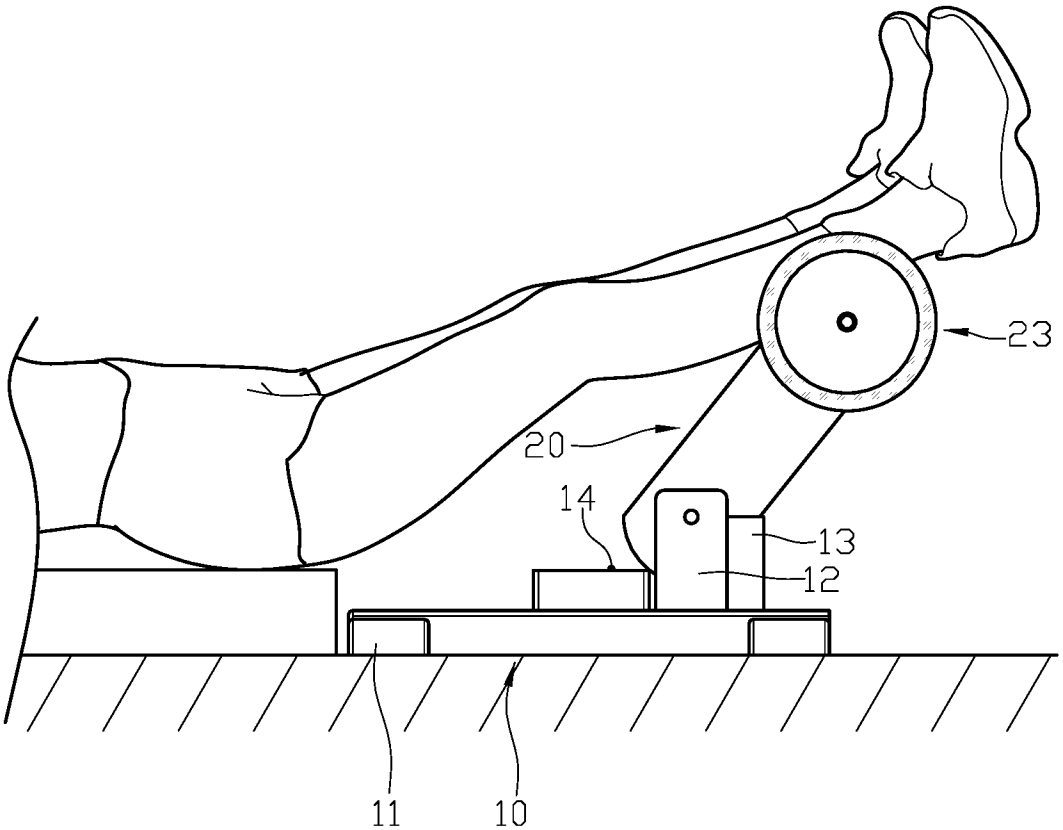
FIG. 12 is another schematic diagram showing the user lying down on the preferred embodiment according to the present invention.

In addition, when the massage mechanism is used, the angle of the swinging arm 20 can be adjusted freely, so the user can have the lower limb be massaged while lying down or sleeping. Please also refer to the FIGS. 10,11 and 12, when the swinging arm 20 is brought up by the second motor 25 to form a raised state, the leg can be supported upwards and higher than the heart, which helps the blood return to the heart and the lungs for oxygen to help leg muscles to rest and relax, and then the massaging rollers 23 massage the muscle to eliminate soreness, fatigue and other discomforts for better blood circulation.

Figure 13:
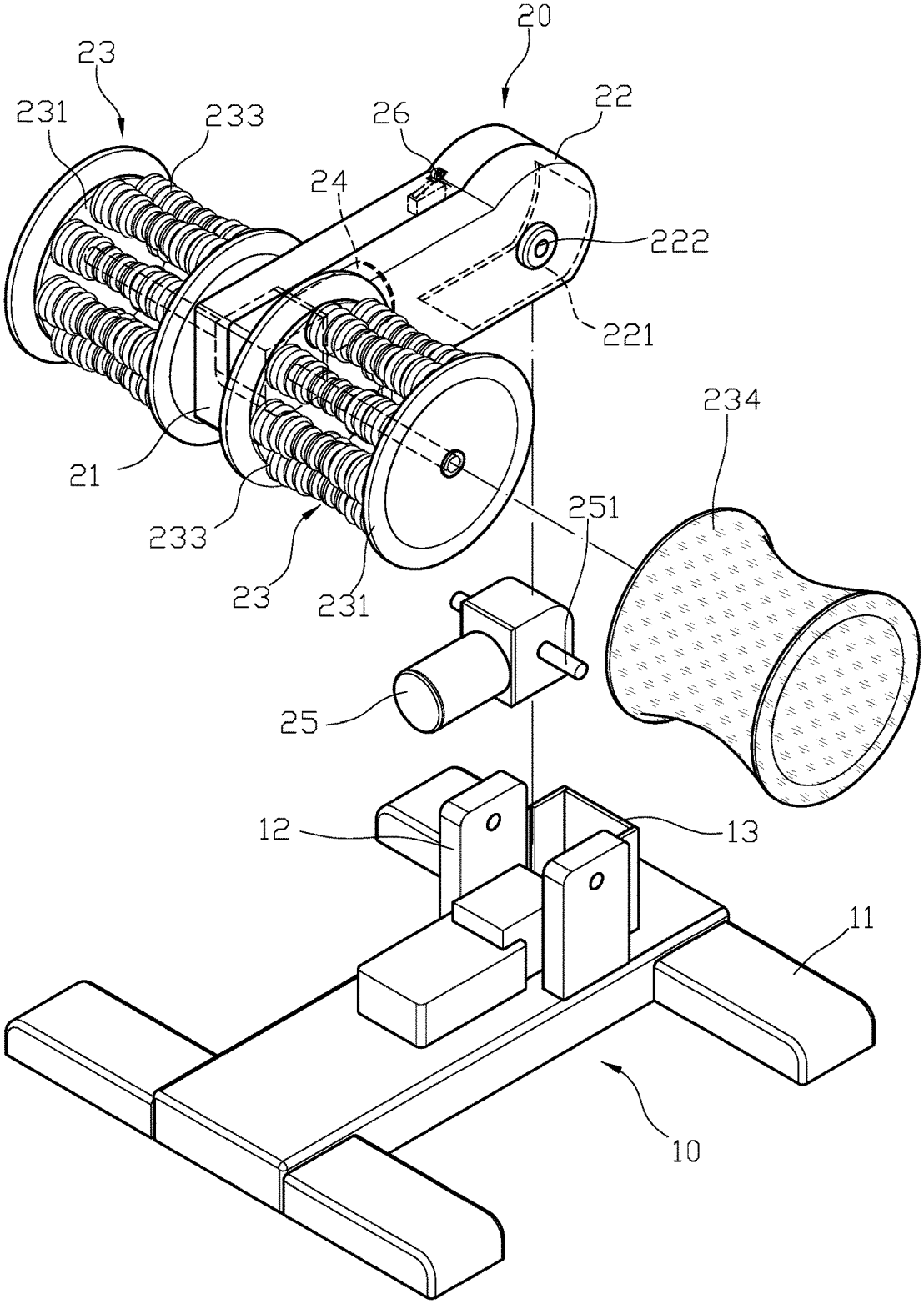
FIG. 13 is an exploded view of another embodiment according to the present invention.
Figure 14:
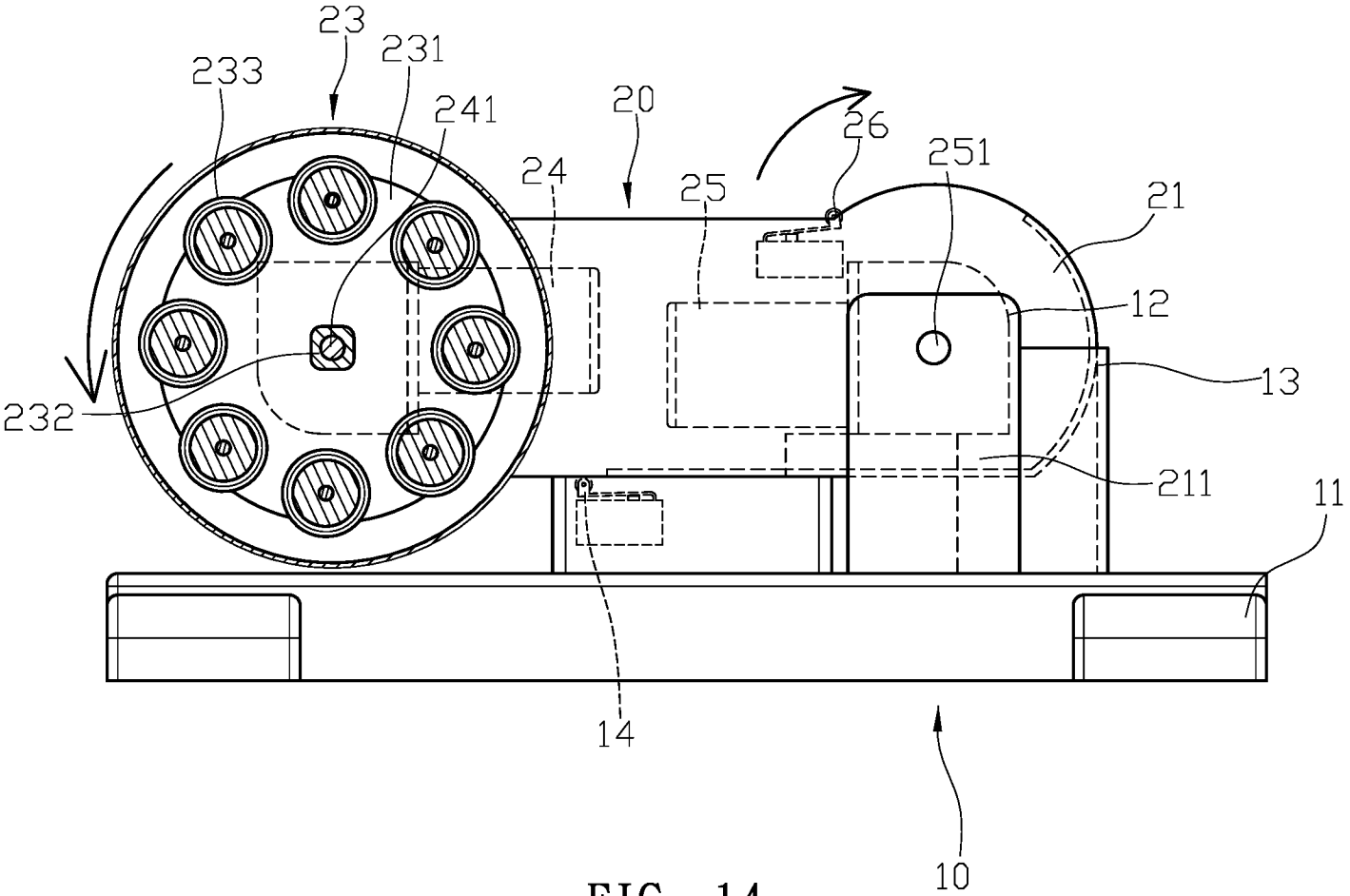
FIG. 14 is a side view of another embodiment according to the present invention.
Figure 15:
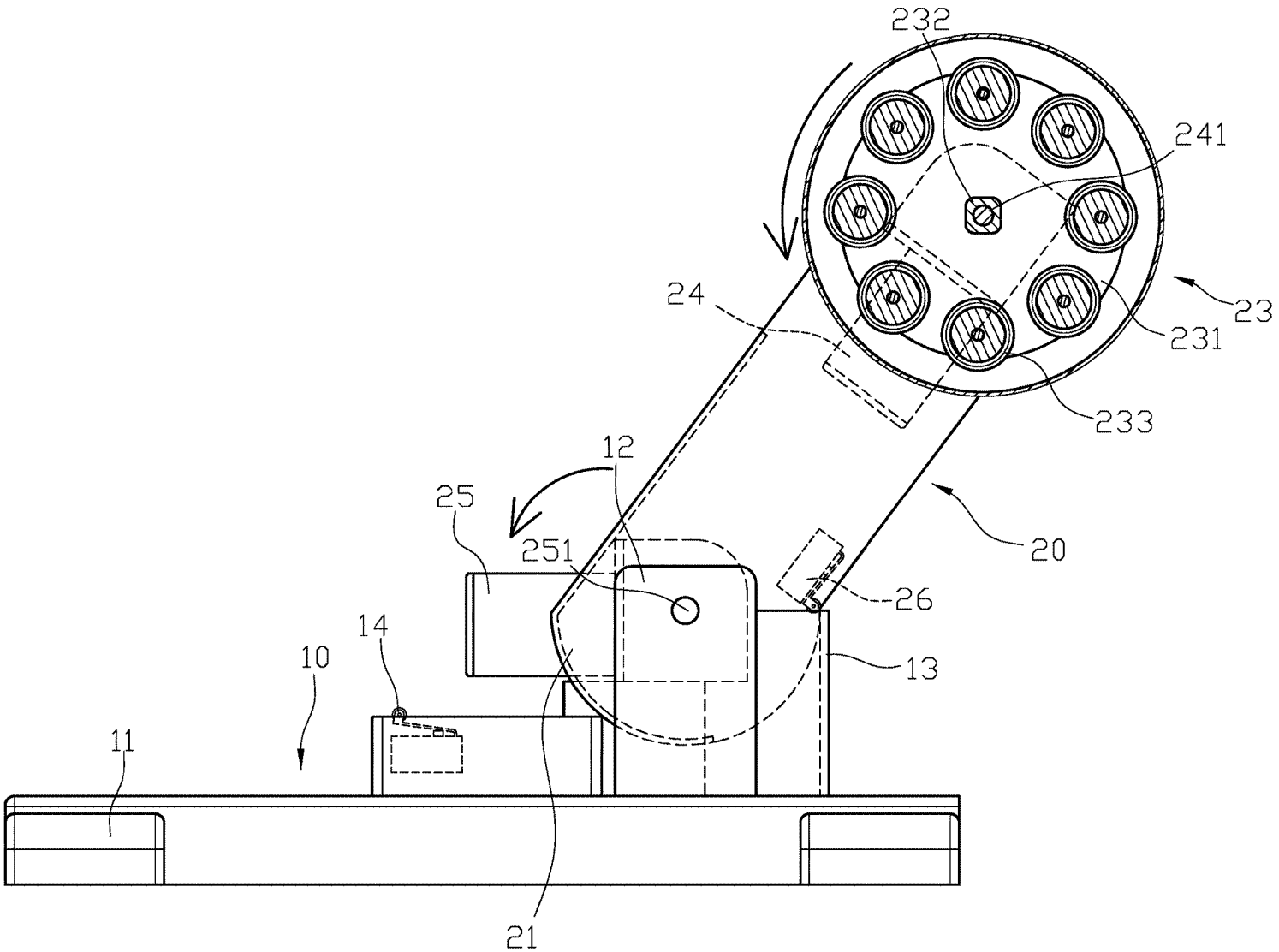
FIG. 15 is a schematic view of a swinging state of another embodiment according to the present invention.

For another embodiment of the structure, please refer to FIGS. 13, 14, and 15. The bottom side of the swinging arm 22 of the swinging arm 20 is provided with an accepting slot 221, both sides of the accepting slot 221 have an assembling aperture 222 passing through the swinging end 22, the second motor 25 is housed in the accepting slot 221, and the shaft rods 251 on both sides of the second motor 25 is passed through the two assembling apertures 222 connecting the swinging end 22 between the two assembling posts 12. Since, the second motor 25 is fixed between the two assembling posts 12, the second motor 25 is capable of driving the two shaft rods 251 to rotate, and the swinging arm 20 is driven by the two shaft rods 251 between the two assembling posts 12. The first limit switch 14 in front of the two assembling posts 12 of the base 10 and the second limit switch 26 on outside of the swinging arm 20 are configured for controlling the swinging movements of the swinging arm 20 and the two massaging rollers 23 of the massaging end 21 to achieve the massaging effect.

With the structure of the above specific embodiment, the following benefits can be obtained: (1) The massaging mechanism of the present invention is composed of a base 10 and a swinging arm 20, and the massaging end 21 of the swinging arm 20 is provided with the two massaging rollers 23. When the structure is used, the simultaneous actuations of the first motor 24 and the second motor 25 can achieve the swing circulation massage effect on the lower limbs, which helps to expand the range of massage. Furthermore, when the swinging arm 20 swings upward to lift the lower limb for support to achieve muscle relaxation, thereby improving the massage effect of the lower limb muscles.

(2) The swinging arm 20 can also be switched for a fixed point massage, which can locally emphasizes the lower limb muscles with more soreness and discomfort, and increase the practicability of the structure.

(3) The massage device can operate when the user is sitting or lying down with the swinging arm 20 when the user is lying down. When the swinging arm 20 is brought up by the second motor 25 to form a raised state, the leg can be supported upwards and higher than the heart, which helps the blood return to the heart and the lungs for oxygen to help leg muscles to rest and relax, and then the massaging rollers 23 massage the muscle to eliminate soreness, fatigue and other discomforts for better blood circulation.

(4) The swinging arm 20 can be swung to the bottom to be horizontal with the base 10, which greatly reduces the volume of the massage device for easy storage.

Although the present invention has been explained in relation to its preferred embodiment, it is to be understood that many other possible modifications and variations can be made without departing from the spirit and scope of invention as hereinafter claimed.

What is claimed is:

1. A rotatable leg massage device comprising:

a base having two opposing assembling posts at one end and a limiting baffle behind and between the two assembling posts;

a swinging arm having a massaging end and a swinging end, the massaging end provided with a respective massaging roller on two sides, a first motor configured to rotate the two massaging rollers, the swinging end disposed between the two assembling posts of the base, a second motor disposed between the swinging end and the two assembling posts and configured to drive the swinging arm to rotate around the base.

2. The rotatable leg massage device as claimed in claim 1, wherein two sides of the base are each provided with a foot stand, a first limit switch is mounted in front of the two assembling posts, a second limit switch is mounted on the swinging arm adjacent the swinging end, and the first and second limit switches are both electrically connected to the second motor.

3. The rotatable leg massage device as claimed in claim 1, wherein the limiting baffle is U-shaped, and a highest point of the limiting baffle is lower than the two assembling posts such that the swinging arm is able to have a rotation angle larger than 90° relative to the base.

4. The rotatable leg massage device as claimed in claim 1, wherein the two massaging rollers each further comprise a circular disk connected to a shaft, and the two circular disks are provided with a plurality of massaging units there between, the first motor drives a central shaft to rotate with the shaft of the two massaging rollers together.

5. The rotatable leg massage device as claimed in claim 1, wherein the two massaging rollers are both covered by a cloth cover.

6. The rotatable leg massage device as claimed in claim 1, wherein the second motor is mounted on the swinging end of the swing arm, and opposing ends of the second motor have a shaft rod passing through the swinging end and engaged with the two assembling posts.

7. The rotatable leg massage device as claimed in claim 1, wherein the swinging end of the swinging arm further comprises an accepting slot, the accepting slot having an assembling aperture through the swinging end, the second motor disposed in the accepting slot, and the second motor has a shaft rod at two sides passing though the assembling aperture of the swinging end and held between the two assembling posts, such that the second motor is limited between the two assembling posts and drives the swinging arm via the shaft rod.

* * * * *